US007641178B2

(12) United States Patent
MacDonald et al.

(10) Patent No.: US 7,641,178 B2
(45) Date of Patent: Jan. 5, 2010

(54) COLUMN BLOCK SYSTEM

(75) Inventors: Robert A. MacDonald, Plymouth, MN (US); William B. Dawson, Medina, MN (US)

(73) Assignee: Keystone Retaining Wall Systems, Inc., Bloomington, MN (US)

( * ) Notice: Subject to any disclaimer, the term of this patent is extended or adjusted under 35 U.S.C. 154(b) by 561 days.

(21) Appl. No.: 11/117,638

(22) Filed: Apr. 28, 2005

(65) Prior Publication Data

US 2005/0252146 A1 Nov. 17, 2005

Related U.S. Application Data

(60) Provisional application No. 60/566,628, filed on Apr. 29, 2004.

(51) Int. Cl.
*E04H 17/14* (2006.01)
*E04C 1/00* (2006.01)

(52) U.S. Cl. ..... 256/19; 256/24; 52/770; 52/606; 52/169.9; 52/592.6

(58) Field of Classification Search ..... 52/169.9, 52/169.4, 169.1, 169.3, 295, 604, 223.7, 52/781.5, 781.3, 764, 592.6, 284, 605, 606, 52/607, 770; 256/19, 24; 405/286; D25/113, D25/114, 115, 118

See application file for complete search history.

(56) References Cited

U.S. PATENT DOCUMENTS 314,022 A * 3/1885 Heard ..... 52/605
3,298,668 A * 1/1967 Schueren ..... 256/19
4,107,894 A * 8/1978 Mullins ..... 52/592.6
4,186,540 A 2/1980 Mullins
4,726,567 A * 2/1988 Greenberg ..... 256/19

(Continued)

FOREIGN PATENT DOCUMENTS

DE 296 02 741 U1 5/1996

(Continued)

OTHER PUBLICATIONS

TheFreeDictionary, Mortar, accessed May 29, 2009, http://encyclopedia2.thefreedictionary.com/mortar, pp. 1-2.*

(Continued)

*Primary Examiner*—Robert J Canfield
*Assistant Examiner*—Jessie Fonseca
(74) *Attorney, Agent, or Firm*—Popovich, Wiles & O'Connell, P.A.

(57) ABSTRACT

A system of blocks is configured to be compatible with each other in the construction of a columnar structure. Each block has four faces and all four faces may generally have the same dimensions. The width of the blocks may generally be about twice their height. The faces of the block also may contain a slot to add an aesthetic appearance to the column. The blocks have certain constructions features that mate with specially constructed brackets in attaching a fence panel to the completed column.

The blocks have interlocking elements or projections that permit positive connection between courses of blocks. Projections of one block extend into the core another block. Adjacent blocks can be rotated 90 degrees relative to each other about a vertical axis of each block with each course. The blocks can be used to construct a column that is easy to install and structurally sound.

4 Claims, 16 Drawing Sheets

U.S. PATENT DOCUMENTS

| | | | | |
|---|---|---|---|---|
| 4,887,403 | A | 12/1989 | Bonner | |
| 5,575,128 | A | 11/1996 | Haener | |
| 5,623,797 | A | 4/1997 | Gravier et al. | |
| 5,761,861 | A * | 6/1998 | Brackett | 52/218 |
| 5,899,040 | A * | 5/1999 | Cerrato | 52/604 |
| 5,934,035 | A | 8/1999 | Rasmussen et al. | |
| 5,938,184 | A * | 8/1999 | DeSouza | 256/19 |
| 6,029,954 | A * | 2/2000 | Murdaca | 256/59 |
| 6,065,265 | A | 5/2000 | Stenekes | |
| 6,176,049 | B1 | 1/2001 | Crant et al. | |
| 6,185,888 | B1 * | 2/2001 | Wasson | 52/300 |
| 6,192,629 | B1 * | 2/2001 | Akins et al. | 49/382 |
| 6,374,556 | B2 | 4/2002 | Crant et al. | |
| 6,398,193 | B1 * | 6/2002 | DeSouza | 256/65.06 |
| D467,009 | S * | 12/2002 | Agee | D25/113 |
| 6,564,524 | B1 * | 5/2003 | Gruita | 52/604 |
| 6,571,521 | B1 * | 6/2003 | Ameigh | 52/295 |
| 6,578,338 | B1 | 6/2003 | Nanayakkara | |
| 7,025,335 | B2 * | 4/2006 | Zhu | 256/22 |
| 2003/0089068 | A1 | 5/2003 | Ameigh | |

FOREIGN PATENT DOCUMENTS

| | | |
|---|---|---|
| FR | 2592668 | 7/1987 |
| FR | 2705712 | 12/1994 |

OTHER PUBLICATIONS

U.S. Appl. No. 60/566,590, filed Apr. 29, 2004.
U.S. Appl. No. 60/566,554, filed Apr. 29, 2004.
U.S. Appl. No. 60/566,616, filed Apr. 29, 2004.
U.S. Appl. No. 60/566,617, filed Apr. 29, 2004.
Search Report for International Application No. PCT/US2005/014675 (14 pages).

* cited by examiner

COLUMN BLOCK SYSTEM

This application claims the benefit of provisional application Ser. No. 60/566,628, filed Apr. 29, 2004, the contents of which are hereby incorporated herein by reference.

FIELD OF INVENTION

A block for use in a system of interlocking modular blocks is described. In particular, blocks suitable for forming columns are described.

BACKGROUND OF THE INVENTION

Columnar structures used for decoration or as support for fence panels, gates or other such structures have required a considerable amount of skill and effort to erect. Conventional systems primarily include mortared masonry blocks. Columns or pillars also have been made from stone, but this requires skilled craftspeople to ensure proper structural completion.

Modular blocks have also been used to build columns or pillars. Such blocks can be installed without special skill. The advantages to such blocks are that they are a convenient size, a consistent size, and installation costs are less because of the lack of dependence on skilled labor. Blocks known in the art use construction adhesive to strengthen connection between layers and may be used with mortar to simulate the appearance of a more conventional block and mortar column.

An important feature of the building blocks is their appearance. The look of weathered natural stone is very appealing for columns and other similar structures. The art provides several methods to produce concrete blocks having an appearance that to varying degrees mimics the look of natural stone. According to one well-known method, blocks are individually formed in a mold and the surfaces are textured by removal of the mold. Additional machine texturing processes can then be applied. The look of smooth cut stone can also be very attractive for columns and other structures. The smooth texture provides a more straight edge, formal, geometric shape for the block and overall structural appearance.

A need in this art remains for blocks that can be used to construct mortarless, sturdy, reinforceable columns that have a desired appearance.

SUMMARY OF THE INVENTION

This invention is a system of blocks configured to be compatible with each other in the construction of a columnar structure. Each block has four faces that can either be textured in a manner resulting in an appearance like that of natural stone, or can be smooth to give a more formal appearance. All four faces of the block generally have the same dimensions. The faces of the block also may contain a slot to give the block a more aesthetic appearance by simulating the appearance of multiple blocks.

The blocks are provided with at least one interlocking element that permits a positive connection between courses of the blocks when the interlocking element is received in an overlying block. In one embodiment, the blocks interlock when there is a 90 degree rotation about a vertical axis of each block with each course. The blocks may be placed over a pipe or post-tensioning rod that is anchored into a foundation element in the ground. The core and the interlocking elements may be shaped to accommodate such a pipe and or post-tensioning rod. The blocks can be used to construct a column with a natural stone-like appearance or smooth appearance depending upon which type of block was used. Cores of stacked blocks form a passage through which vertical reinforcement can be used. This building block system is designed to be easy to install and structurally sound.

DETAILED DESCRIPTION OF THE PREFERRED EMBODIMENTS

Figure 1:
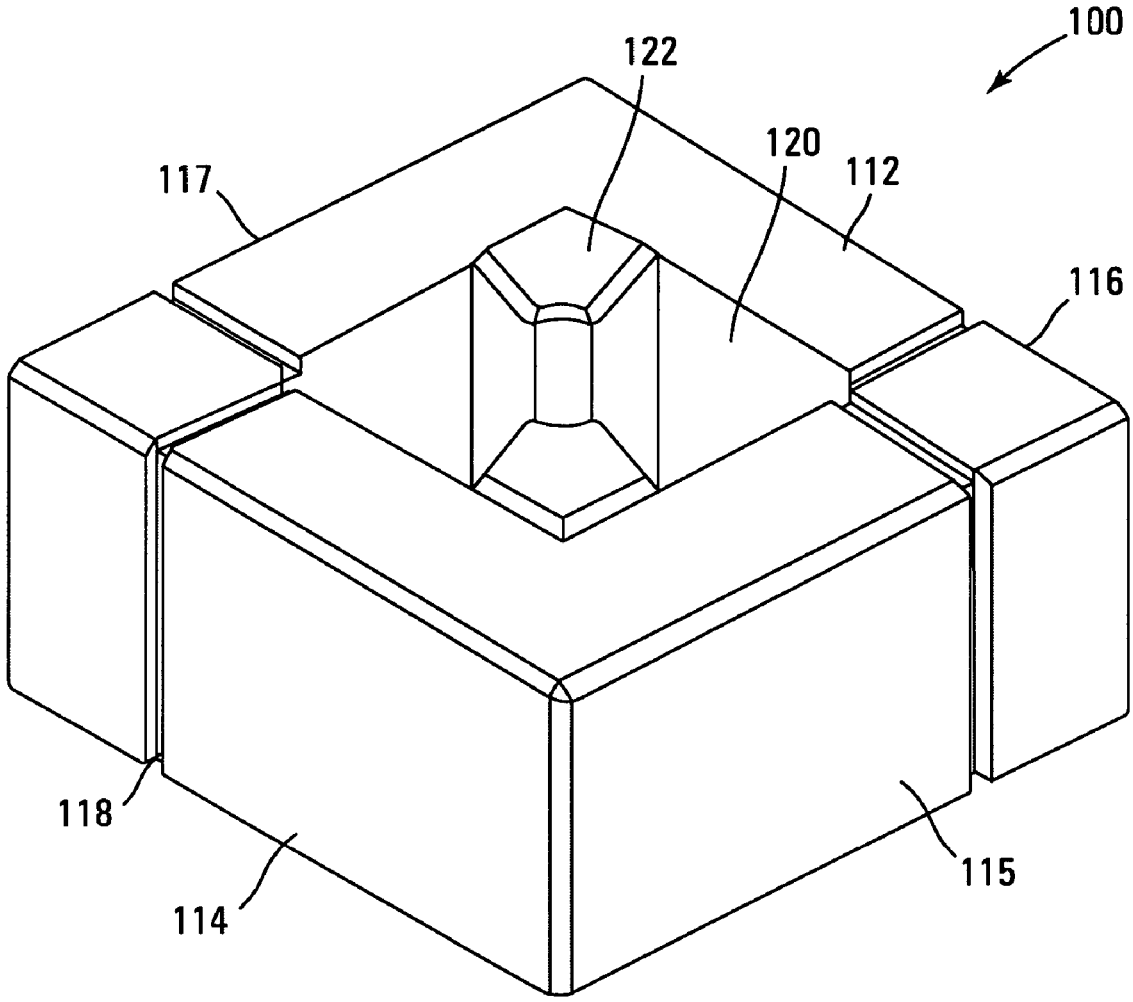
FIG. 1 is a perspective view of a building block according to this invention.
Figure 2:
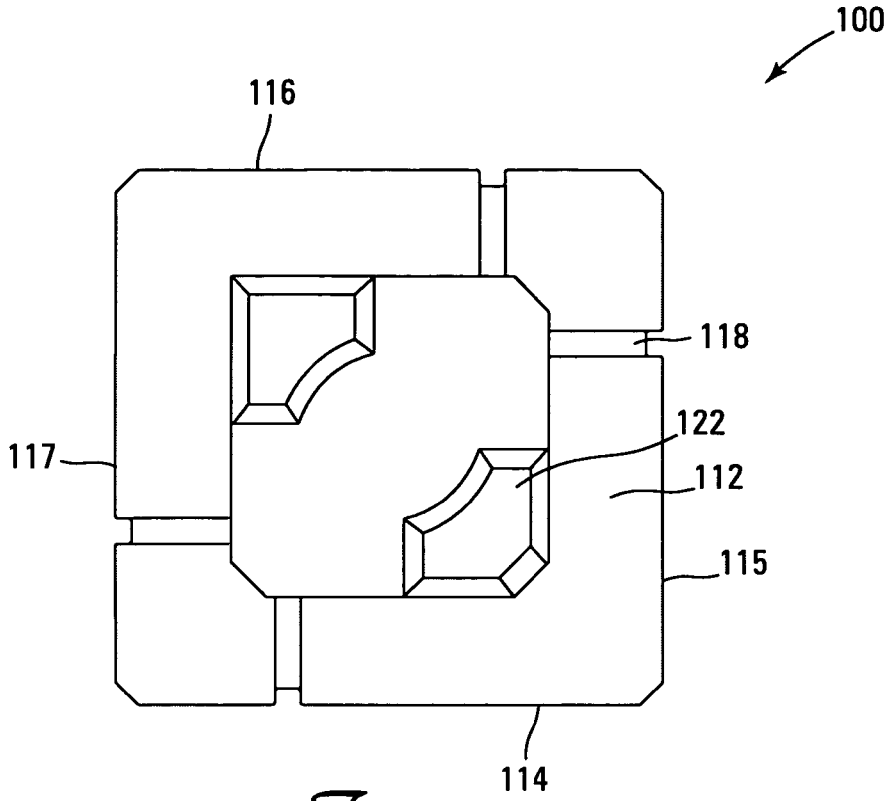
FIG. 2 is a top view of the building block of FIG. 1.
Figure 3:
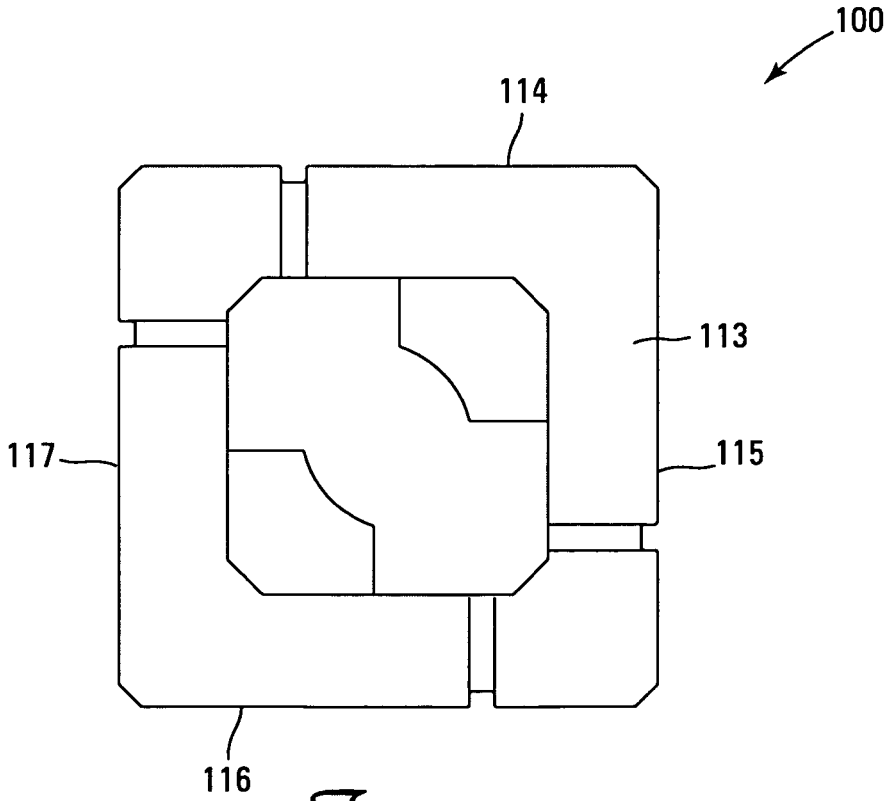
FIG. 3 is a bottom view of the building block of FIG. 1.
Figure 4:
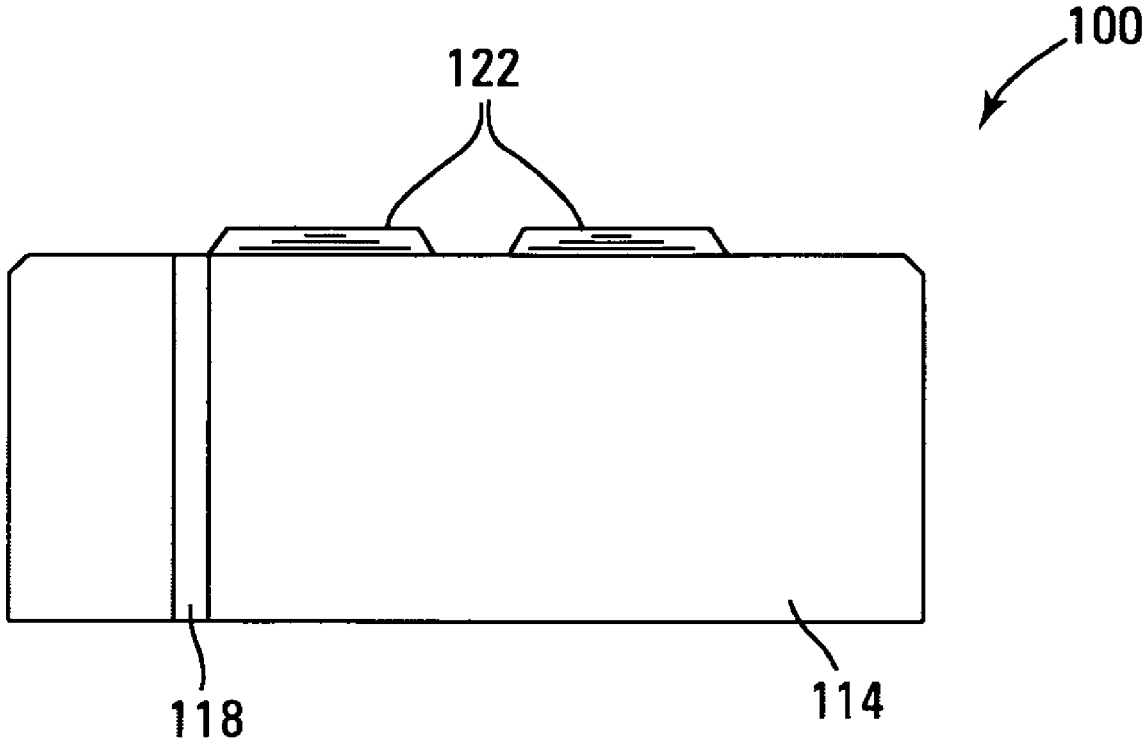
FIG. 4 is a side view of the building block of FIG. 1.

In this application, "upper" and "lower" refer to the placement of blocks as a column is constructed. The lower or bottom surface of blocks is the surface that faces the ground in a column. The first course of the column is formed by placing one block so that its lower surface is face-down. Subsequent courses are formed by stacking blocks so that an interlocking element or projection from one block fits into an indentation or void of an overlying block. "Top" and "bottom" surfaces are defined as those most conventionally used for these blocks, however, the blocks can be used with tops and bottom reversed.

The blocks of this invention may be made of a rugged, weather resistant material, such as concrete, especially if the columnar structure is constructed outdoors. Other suitable materials include plastic, reinforced fibers, wood, metal and stone. The surface of the blocks may be smooth or may have a roughened appearance, such as that of natural stone. The blocks typically are formed in a mold and various textures can be formed on the surface, as is known in the art.

Each block has four faces which can either be textured in a manner resulting in an appearance like that of natural stone, or can be smooth to give a more formal appearance. All four faces of the block may have the same dimensions. One or more faces of the block optionally may contain one or more slots that will be visible in the columnar structure to give a column of blocks a more aesthetic appearance.

In typical use, the interlocking element extends above the top surface of the block and projects into an indentation in an overlying block. In a preferred embodiment, the indentation is the core; that is, the core extends through the thickness of the block. In one preferred embodiment, two interlocking elements extend above the top surface of the block into the core of the overlying block, thus producing positive interconnection between facing surfaces. In a preferred embodiment, each successive block is rotated by 90 degrees about its vertical axis thus causing the interlocking elements to project into the core of the block above it. The interlocking elements hold the blocks in place and eliminate the need for mortar when constructing the column.

Rotation of each block about its vertical axis also varies the location of the slot, if present, resulting in a more eye-pleasing pattern for the column. Rotation of the blocks as a column is built also serves to produce a straight column. Because block molding processes may result in uneven blocks, stacking the blocks all in the same orientation may cause a column to tilt or lean. This problem is usually solved by shimming the blocks to make them level. With the block system of this invention, shimming is unnecessary.

The blocks can be used to form various types of columns, such as free standing, decorative columns, gate columns, or columns for use with fence panels.

Turning now to the drawings, the blocks of this invention are described. FIGS. 1 to 4 show block 100, comprising top or upper surface 112, bottom or lower surface 113, first and second opposed sides 114 and 116, and third and fourth opposed sides 115 and 117. Top surface 112 is spaced apart from opposing lower surface 113, thereby defining a block thickness. Opposed sides 114/116 and 115/117 have substantially the same surface area. The top and bottom surfaces 112, 113 together with the first through fourth sides 114, 115, 116 and 117 form block body 100.

The surfaces of the block meet to form edges and corners. The corners may be beveled, chamfered or rounded to give a more weathered natural stone-like appearance.

Block 100 has optional slot 118 on each side. The slot is a trough on the side and top surfaces, extending from the bottom surface to the core. The slot results in a desirable appearance of stacked blocks, aids in positioning the block when forming a column, and allows the top surface to receive a bracket so that the block can be attached to a fence segment, as described further below.

Block 100 is provided with core 120 located in the center of the block. Core 120 extends the thickness of the block and is desirable because a core results in reduced weight for the block. The core is also useful when forming a column because vertical reinforcement can be inserted through the vertically aligned cores to lend stability to the columnar structure. For example, concrete grout and rebar, steel pipe, or post-tension rods can be used to fill the core and strengthen the structure.

Core 120 is generally rectilinear, having walls generally parallel to the side surfaces. On opposing inside corners of core 120 are located two interlocking elements 122. These elements extend the thickness of the block, and project above the top surface of the block. They are essentially co-planar or parallel with the bottom surface of the block, that is, the bottom surface of the block is essentially co-planar or contiguous with the bottom surfaces of these elements.

Although neither the interlocking elements nor the core need extend the thickness of the block, typically it is simpler to manufacture the blocks this way. In any event, the interlocking elements extend a distance above the top surface of the block. This distance is sufficient to provide adequate interlocking between blocks when a second block is stacked on a first block.

Block 100 has interlocking elements that are mirror images of each other on a diagonal plane of symmetry through the block. These interlocking elements are positioned to permit the alignment of blocks directly over one another when rotated 90 degrees about the vertical axis of the block. The interlocking elements also help to lock blocks into place, thus adding stability to a column of the blocks. Most preferably, the interlocking elements are shaped so that a pipe or post-tensioning rod can be installed vertically in the center of the block and through the center of the column. That is, as shown in the figures, the portion of the projection facing the center of the core is curvilinear.

It is to be emphasized that it is generally preferred that the blocks be used in the orientation described above, but there is nothing precluding the use of the blocks wherein the projections extend into the core of an underlying block.

Figure 5:
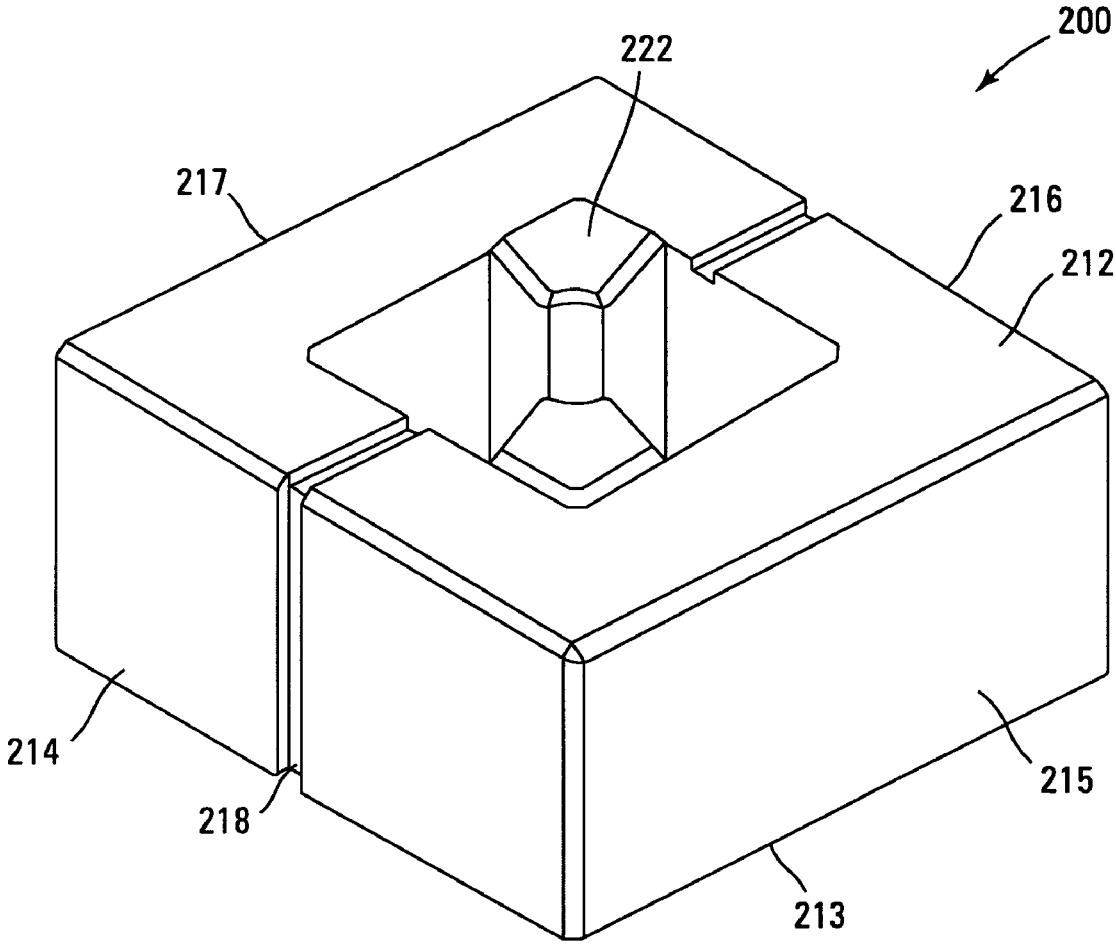
FIG. 5 is a perspective view of another embodiment of a building block of this invention.
Figure 6:
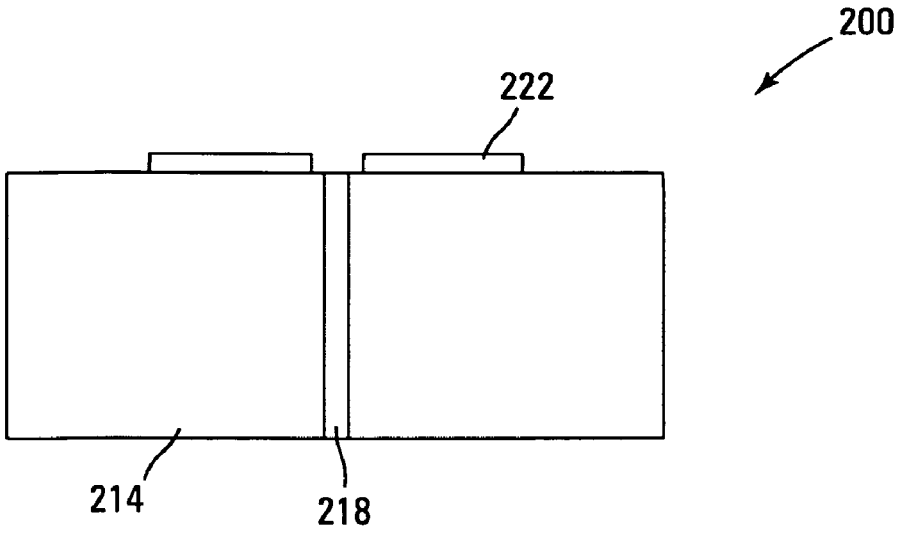
FIG. 6 is a side view of the block of FIG. 5.
Figure 7:
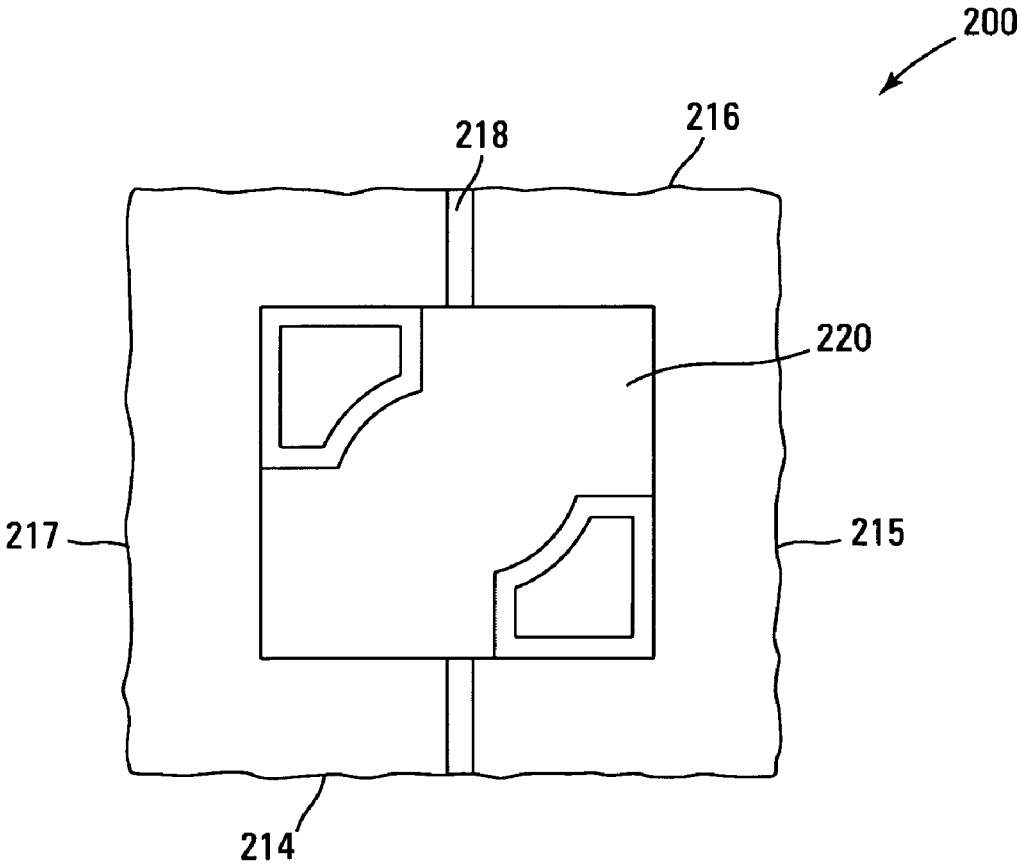
FIG. 7 is a top view of the block of FIG. 5.

FIGS. 5 to 7 illustrate another block 200 of this invention. Block 200 is substantially the same as block 100, except that slots 218 are located at a midpoint on two opposing sides of the block. The slots extend from the bottom of the block to the core.

Block 200 comprises top or upper surface 212, bottom or lower surface 213, first and second opposed sides 214 and 216, and third and fourth opposed sides 215 and 217. Top surface 212 is spaced apart from opposing lower surface 213, thereby defining a block thickness. Opposed sides 214 and 216 and 215 and 217 have substantially the same surface area. The top and bottom surfaces together with the first, second, third, and fourth sides form a block body.

Core 220 extends the thickness of the block. Core 220 is generally rectilinear, having walls generally parallel to the side surfaces. On opposing inside corners of core 220 are located two interlocking elements or projections 222, which project above the top of the block and are parallel with the bottom of the block. The remaining descriptions of the various features of block 100 apply equally to corresponding features of block 200.

Figure 8:
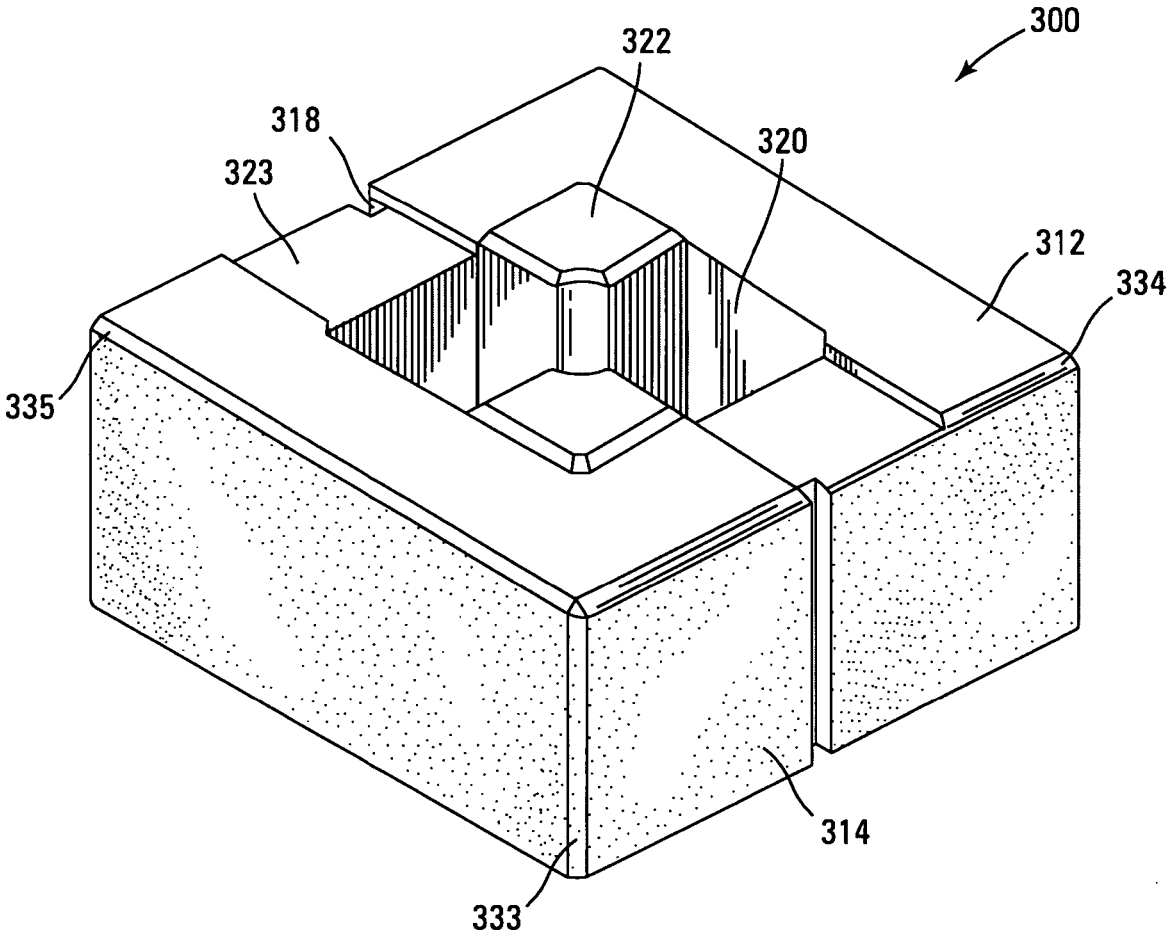
FIG. 8 is a perspective view of yet another embodiment of a building block of this invention.
Figure 9:
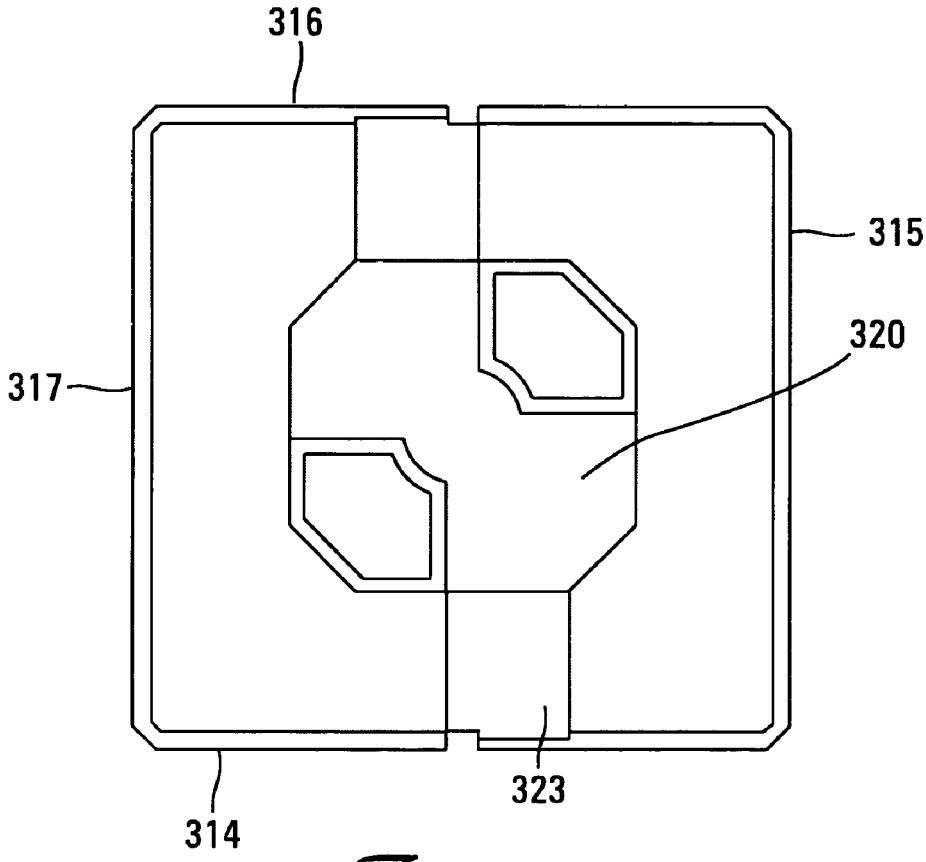
FIG. 9 is a top view of the block of FIG. 8.
Figure 10:
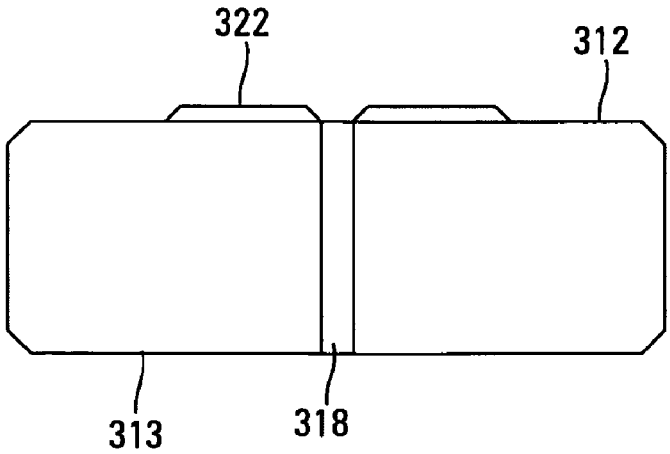
FIG. 10 is a side view of the block of FIG. 8.

FIGS. 8 to 10 show another embodiment of a block, similar to block 200, but having recessed areas opposed to each other on the top surface of the block. The recesses accept variously-shaped brackets and permit the blocks to stack evenly, as will be described further below.

Block 300 comprises top or upper surface 312, bottom or lower surface 313, first and second opposed sides 314 and 316, and third and fourth opposed sides 315 and 317. Top surface 312 is spaced apart from opposing lower surface 313, thereby defining a block thickness. Opposed sides 314 and 316 and 315 and 317 have substantially the same surface area. The top and bottom together with the first, second, third, and fourth sides form a block body. The top edges 334 and 335 of the block are beveled to produce a desired appearance. In addition, the sides meet at beveled corners 333.

Slots 318 are located at a midpoint on two opposing sides of the block, and the slots open onto the top and bottom surfaces of the block. Block 300 has recessed areas 323 on the top surface of the block. Whereas in blocks 100 and 200, the slots (118 and 218, respectively) continue on the top surface of the block, in block 300, instead of the slots, there are recessed areas 323. Recessed areas 323 extend from the sides of the block and open onto the core.

Core 320 extends the thickness of the block. Core 320 is generally rectilinear, having walls generally parallel to the side surfaces. On opposing inside corners of core 320 are located two projections or interlocking elements 322, which project above the top surface of the block. Use of block 300 in the construction of a fence will be described further below. The remaining descriptions of the various features of block 100 apply equally to corresponding features of block 300.

Figure 11:
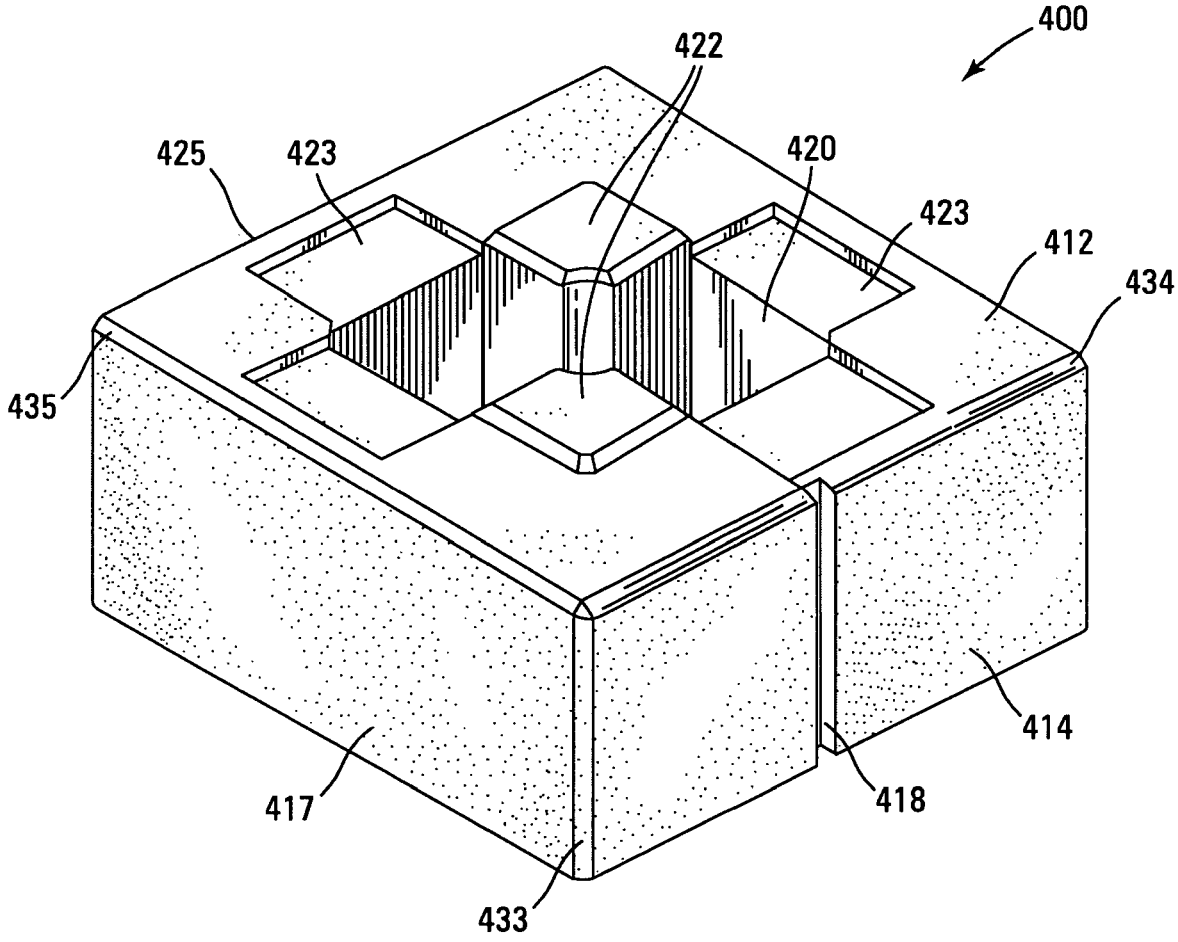
FIG. 11 is a perspective view of still another embodiment of a building block of this invention.
Figure 12:
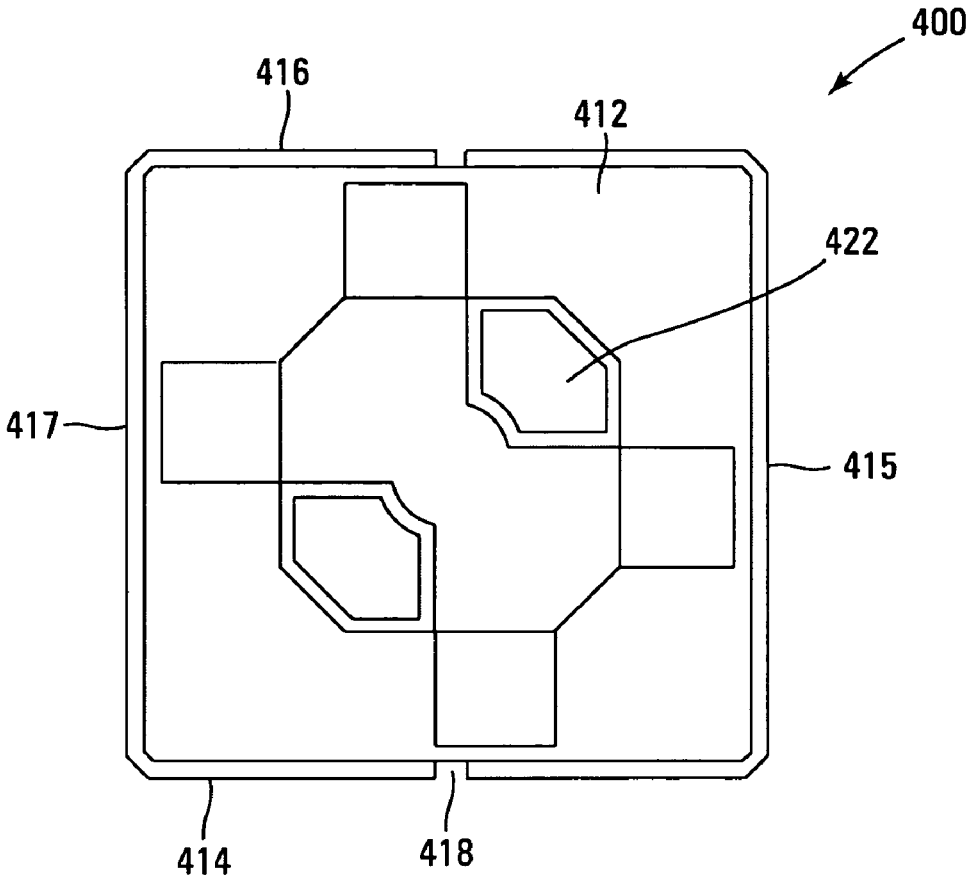
FIG. 12 is a top view of the block of FIG. 11.
Figure 13:
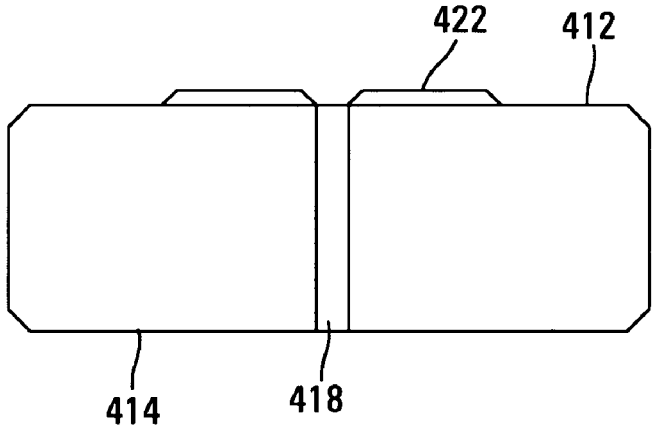
FIG. 13 is a side view of the block of FIG. 11.

FIGS. 11 to 13 illustrate another embodiment of the block of this invention, in which there are four recesses in the top of the block. These permit the use of a bracket during construction of a fence, as will be described later herein; the bracket can be used on any side of the block.

Block 400 comprises top or upper surface 412, bottom or lower surface 413, first and second opposed sides 414 and 416, and third and fourth opposed sides 415 and 417. Top surface 412 is spaced apart from opposing lower surface 413, thereby defining a block thickness. Opposed sides 414 to 417 have substantially the same surface area. Top edges 434 and 435 of the block are beveled and the sides meet at beveled corners 433.

Slots 418 are located at a midpoint on two opposing sides of the blocks and extend from bottom surface 413 to (and through) beveled edge 434. Recessed areas 423 extend from the core toward the beveled top edges but not to the sides of the block. In this way, each side of the block has a desirable appearance for use in any orientation in a column. On the opposite side of the core from each recessed area is projection or interlocking element 422.

Core 420 extends the thickness of the block. Core 420 is generally rectilinear, having walls generally parallel to the side surfaces. On opposing inside corners of core 420 are located two interlocking elements or projections 422, which project above the top surface of the block.

As shown in FIGS. 11 and 12, region 425 on the top of the block is adjacent to both the side surface (i.e., 414 or 416) and the recessed area 423. Region 425 is useful in preventing the flow of caulk or construction adhesive to the outside of the block when used in recessed area 423. When using a bracket with block 400, it may be desirable to remove region 425 to reduce its height to that of recessed area 423, thus allowing a bracket to fit across the recessed area and allowing stacked blocks to lie flat, as will be described further below. For example, when a block comprises concrete, the installer chips this portion away.

The blocks of this invention can be manufactured to any desired dimension; typically, the thickness is about half the width of the block. The width of the block (i.e., the distance between two opposing sides, as measured at a midpoint) typically varies from about 12 inches (30.4 cm) to about 18 inches (45.7 cm). A convenient thickness (i.e., in terms of utility and appearance) is from about 6 inches to about 8 inches (about 15.2 to 20.3 cm). Block dimensions are selected not only to produce a pleasing shape for the desired column, but also to permit ease of handling and installation. Typically, blocks of one thickness are used to construct a column.

The presence of the core serves not only to provide a space for interlocking elements to fit when the blocks are stacked, but it also reduces the weight of the block. It may be desirable to further reduce the weight, to make the blocks easier to handle. This can be done by adding cores in the block. For example, one or more cores can be formed near the corners of the block when the block is molded.

Figure 14:
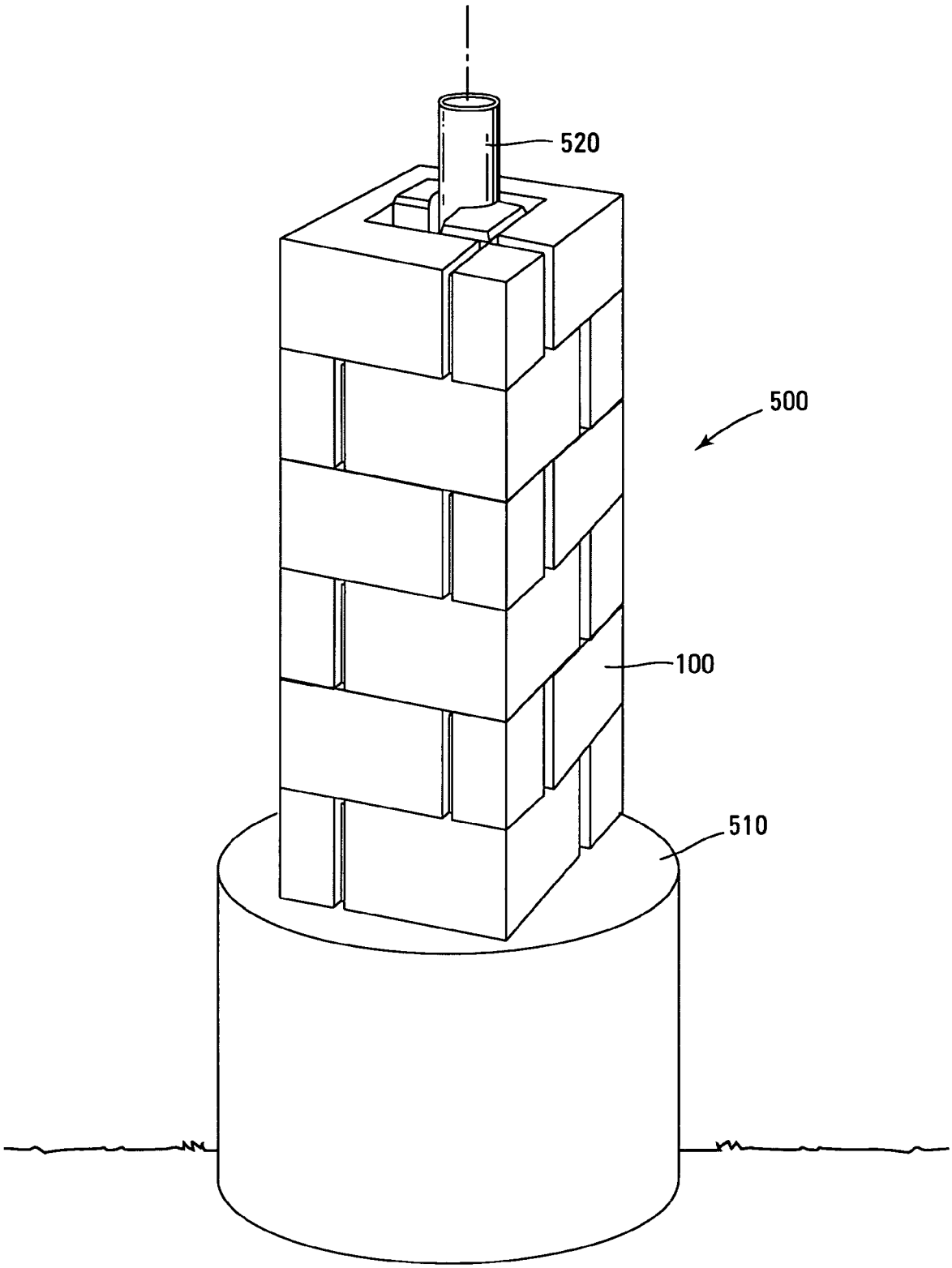
FIGS. 14 and 15 are perspective views of a column of blocks according to this invention.

FIG. 14 shows column 500 formed of blocks 100. A first block is set upon base 510. This base typically comprises concrete and may range in diameter from about 18 to 24 inches (45.7 to 61 cm). The particular foundation element (e.g., the base) is determined based on the load, the soil condition, and other factors by a qualified engineer. Of course, larger diameters may be used to support greater horizontal and vertical loads. The base may be formed by using a tubular form or mold or by other methods as are known in the art.

Base 510 is set into the ground to at least 24 inches (61 cm) or to frost depth as determined by local building codes. The first block is set down and each subsequent block is rotated 90 degrees about its vertical axis and stacked upon a lower block. Thus, the interlocking projections on the upper surface of a block below fit into the core of a block above. The presence of slots 118 is decorative, resulting in a pleasing appearance.

Column 500 is shown with a vertically aligned pipe as an optional interior reinforcement. As a practical matter, the pipe is placed into the foundation element (in the ground), and then a form is built around it for base 510. The blocks are stacked over pipe 520. Pipe 520 is preferably made of galvanized steel and has an outer diameter of about 2.375 inches (about 6 cm).

Figure 15:
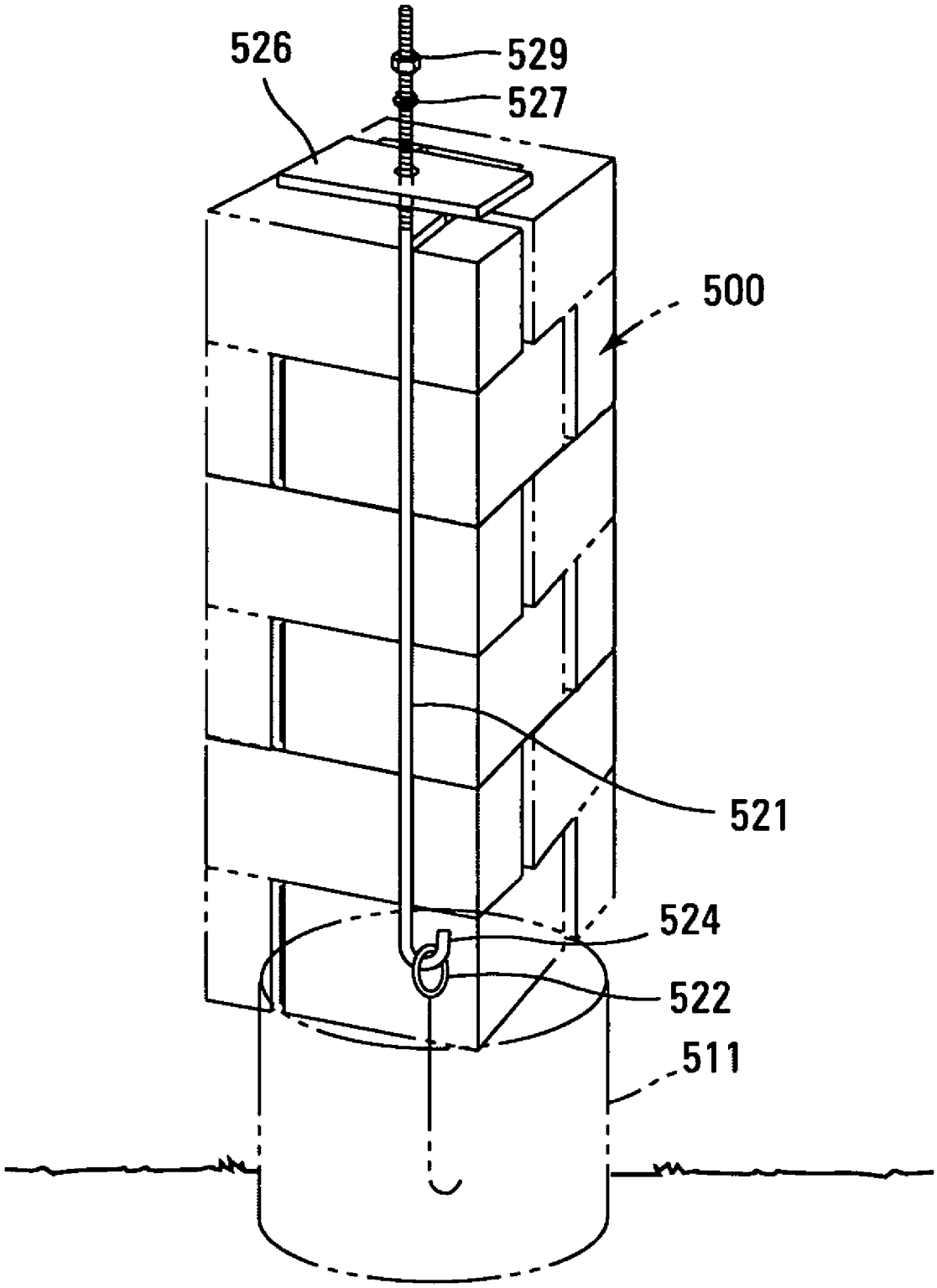

FIG. 15 shows column 500 (in phantom) with a different reinforcement from that of FIG. 14. This reinforcement is a post-tensioning system comprising post-tensioning rod 521, which is tightened after it is installed. There is one mating pair of connectors at the base and another pair of mating connectors at the top of the column. The first mating pair comprises ring 522 and hook 524. Ring 522 is formed into base 511, which typically is formed in place out of concrete. The blocks are stacked, and then a tension rod having hook 524 on the end is threaded through the block cores and hooked onto ring 522. The second mating pair of connectors comprises compression plate 526 and washer/nut 527/529. The tension rod fits through a hole in the plate. Compression plate 526 is placed onto the tension rod at the top of the block column along with nut 529 and washer 527. Nut 529 is turned to produce a specified tension on rod 521.

Figure 16:
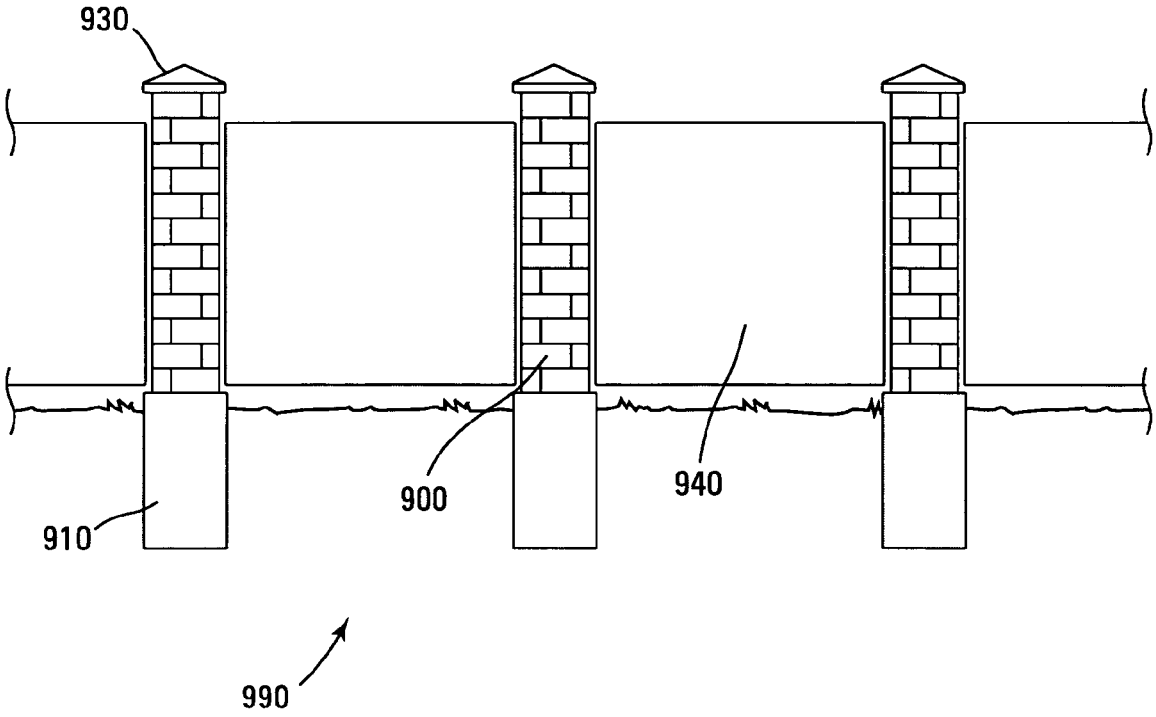
FIG. 16 is a side view of a fence having columns of blocks according to this invention.

FIG. 16 illustrates a side view of fence 990 wherein fence posts 900 are columns comprising the blocks of this invention. Each column 900 is formed on base 910. Preferably, there is reinforcement, such as the pipe of FIG. 14 or the tension rod of FIG. 15, extending through the cores of adjacent blocks in the column to provide additional strength to the column. Cap layer 930 closes the top of each column. The columns are attached to fence panels 940. The fence panels may comprise wood, vinyl, steel, wrought iron, aluminum, plastic, fiberglass, precast concrete, glass, plexiglass, and the like. The panels may be in the form of a picket fence or railing, or they may be solid.

Figure 17A:
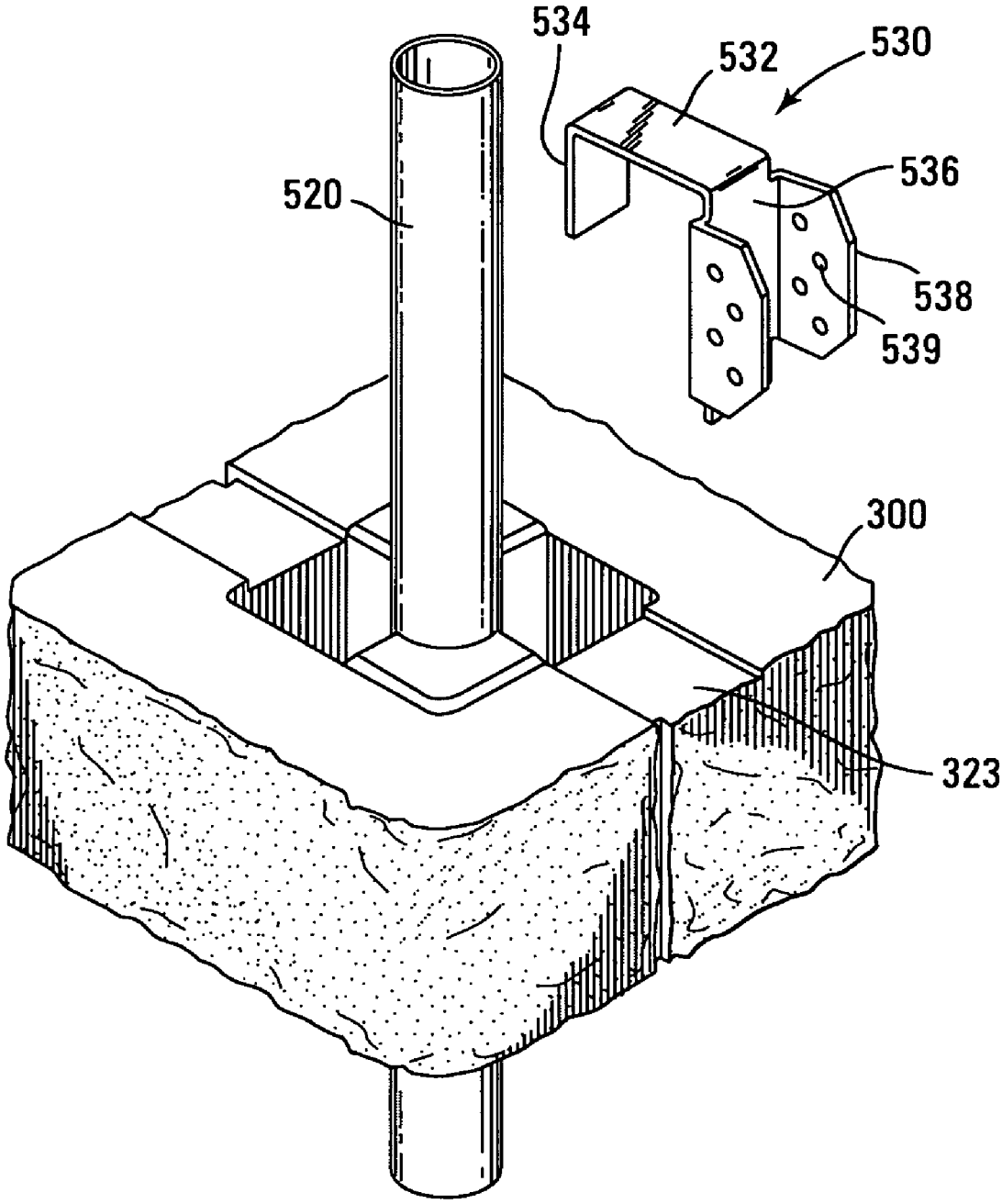
FIGS. 17A and 17B are perspective views of two types of brackets used in conjunction with a block of this invention.
Figure 17B:
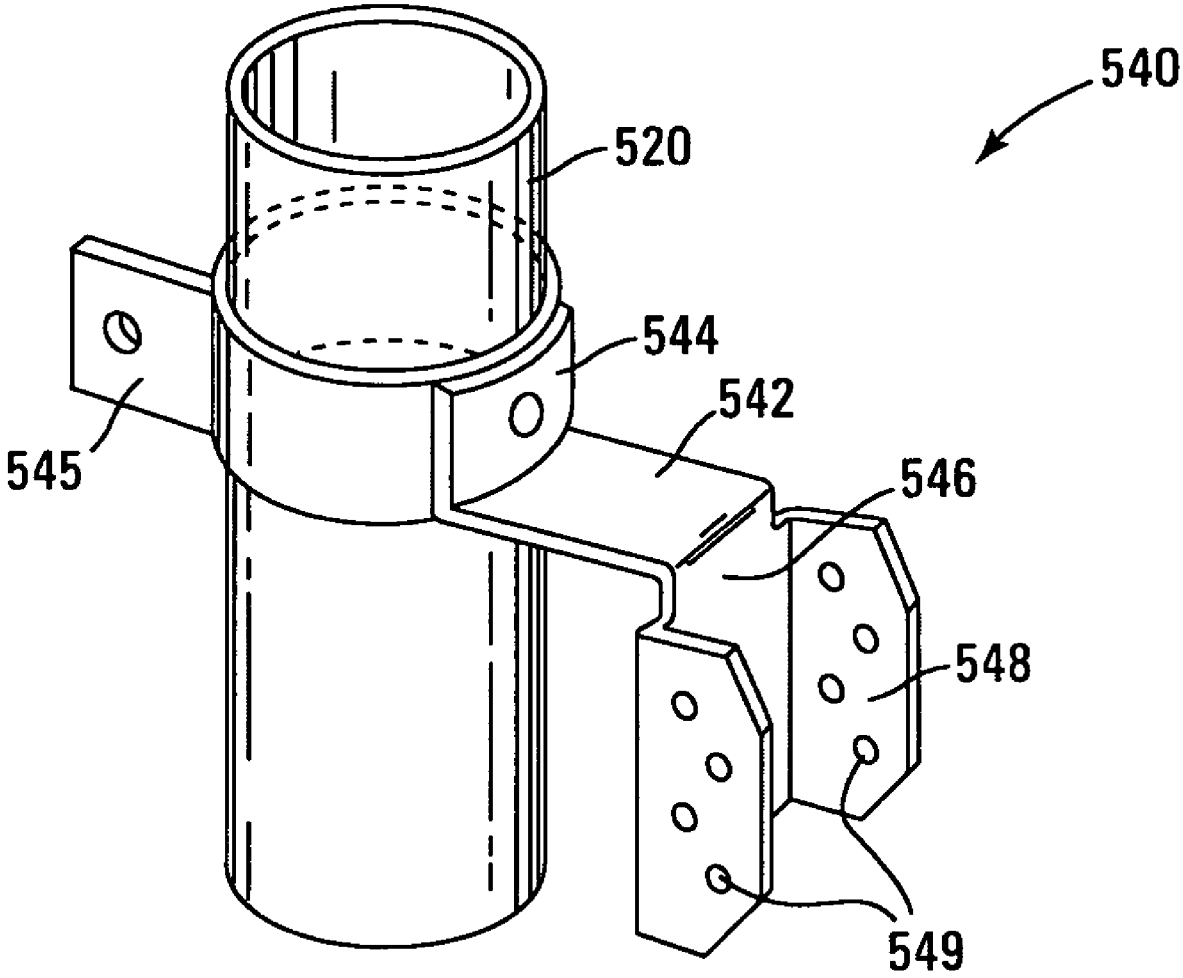
Figure 18:
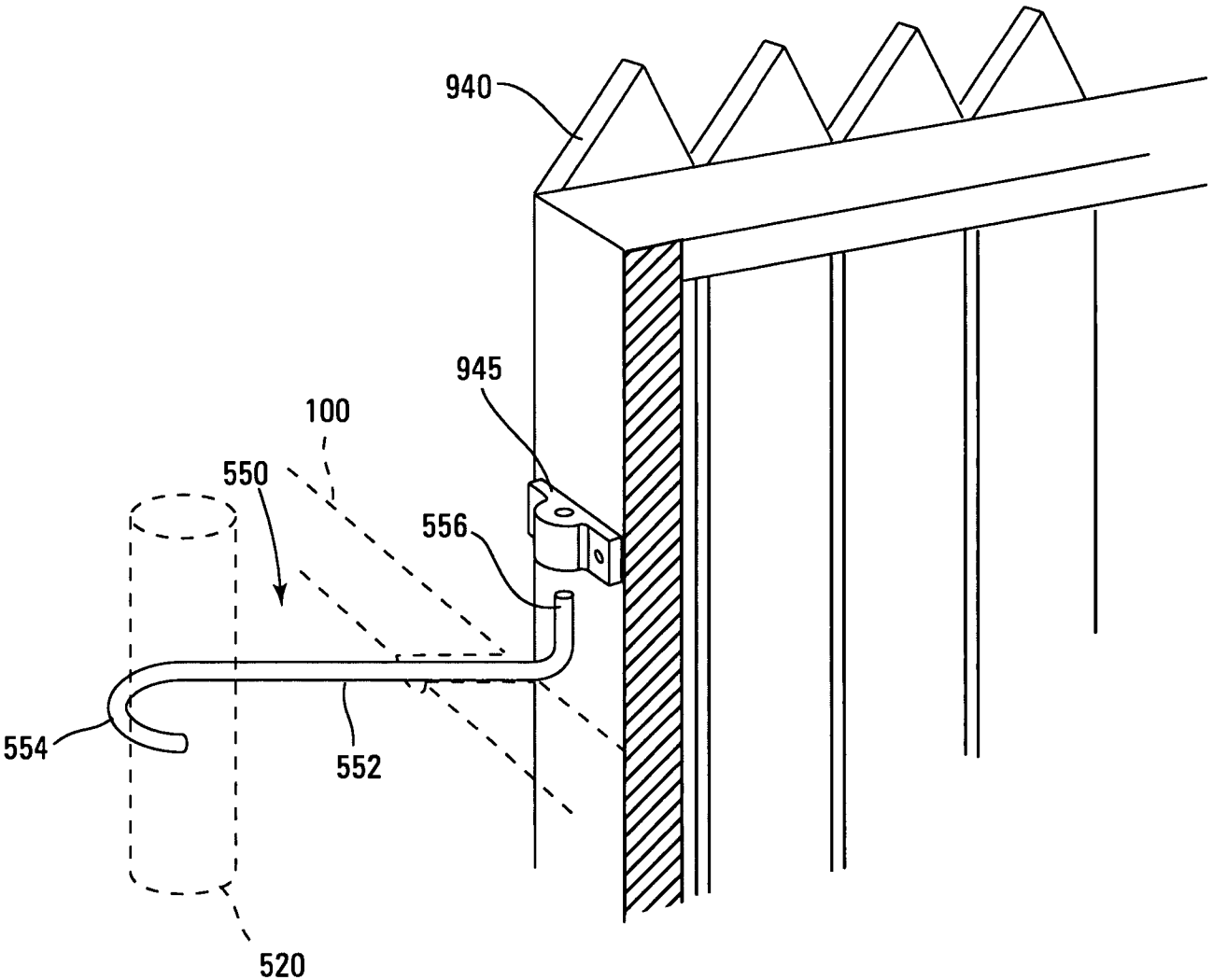
FIG. 18 is a perspective view of another type of bracket used in conjunction with a block of this invention.

Various ways may be used to attach fence panels to the columns, as illustrated in FIGS. 17 and 18. FIG. 17A shows a single block 300, with pipe 520 centered in core 320 and U-shaped bracket 530 that attaches to a fence panel. U-shaped bracket 530 comprises base portion 532, which fits over recessed area 323, arm 534 which lies inside the core of the block, and arm 536, to which are attached extensions 538. Though two extensions are shown, one extension would suffice, and such a bracket. Nails or screws are used through holes 539 to attach bracket 530 to a fence panel.

Bracket 540 is shown in FIG. 17B. For simplicity, no block is shown. This bracket has base portion 542 attached to arm 544, which is attached to ring clamp 545. The ring clamp is affixed around pipe 520 that runs through the cores of the blocks in the column. Arm 546 extends from base portion 542 and has extensions 548 with holes 549 through which nails or screws are placed to attach the bracket to a fence panel.

FIG. 18 shows another kind of bracket 550 that has curved segment 554 that fits around pipe 520 (shown in phantom). Straight portion 552 fits through slot 118 through the top or upper surface 112 of block 100, shown partially in phantom, and terminates at perpendicular segment 556, which fits into holder 945 mounted on fence panel 940. Bracket 550 is thus sandwiched between courses of blocks. This bracket also could be used with block 300, fitting anywhere in the recessed region 323, and could be used with block 400 if a portion of the region 425 were removed. However, the advantage to this bracket 550 is that it fits within a slot on top surface of the block (such as slot 118 in the top surface 112 of block 100 or slot 218 in the top surface 212 of block 200). No additional recessed area is needed to stack blocks evenly in the presence of a bracket. The bracket preferably is made of galvanized steel and has a length sufficient to span the distance from a pipe at the center of the block to a fence panel.

Figure 19A:
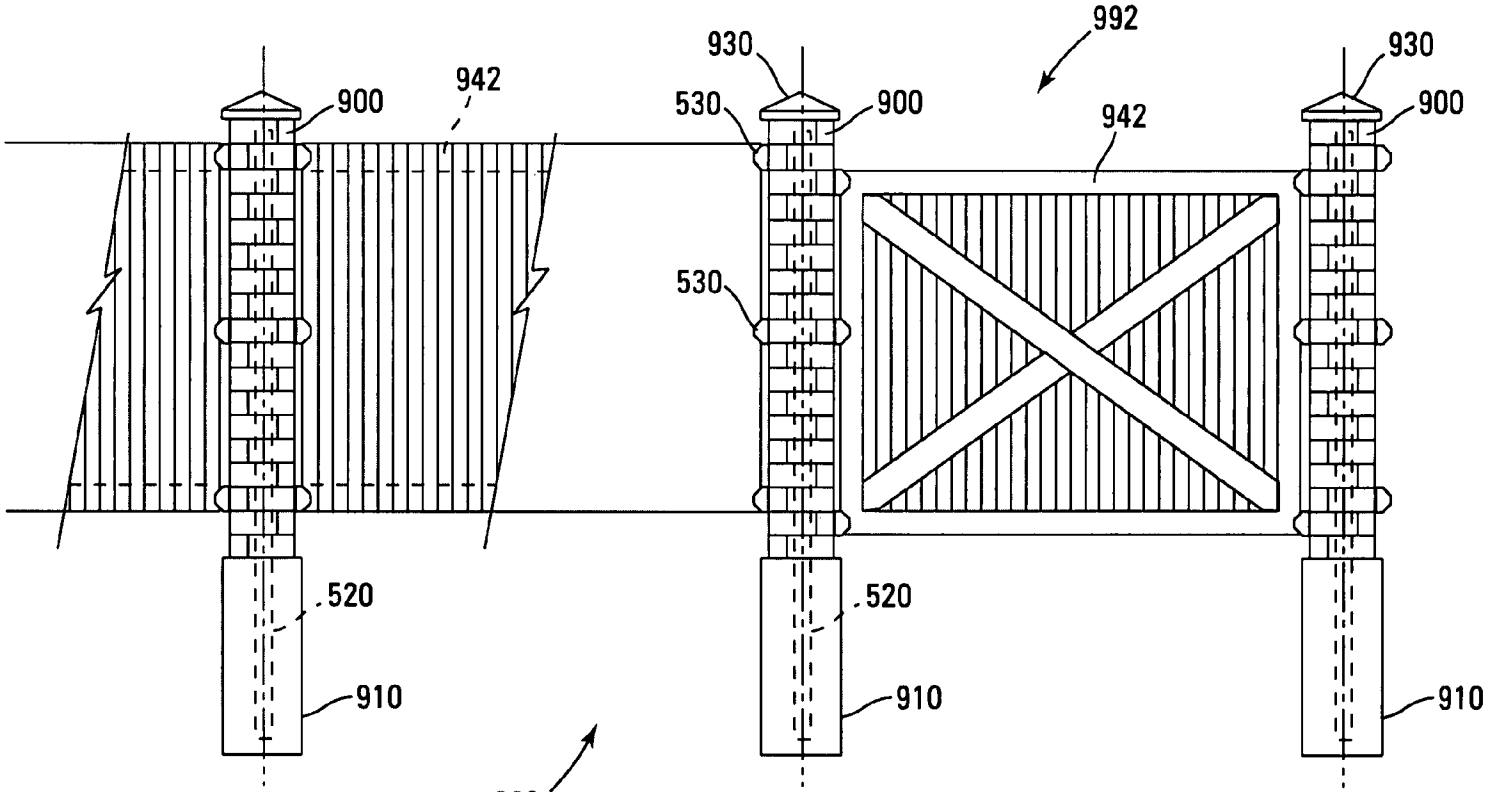
FIG. 19A is a side view of a fence system of this invention and FIG. 19B is a top view of the fence system of FIG. 19A.
Figure 19B:
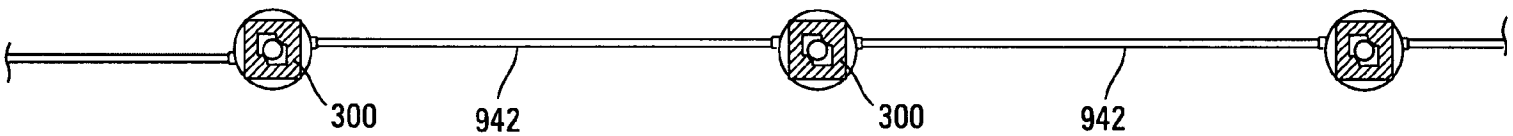

FIG. 19A illustrates a side view of a portion of fence 992 wherein columns 900 comprise blocks 300 and form fence posts for the fence. Each column 900 is formed on base 910 (shown in phantom). Pipe 520 (also shown in phantom) extends through the cores of adjacent blocks in each column and is embedded in base 910. Brackets 530 join fence segments 942 to the columns. Each column is capped with capping block 930. FIG. 19B illustrates a top view of the fence, showing placement of the block without the cap layer in place. This view illustrates how the fence segments are positioned relative to the columns.

Blocks of this invention also may be used with other blocks having interlocking elements, such as those described in commonly assigned, co-pending U.S. application Ser. No. 11/117,640, filed on even date herewith entitled "Columnar Block Fence System,", which claims the benefit of commonly assigned, co-pending U.S. Provisional application Ser. No. 60/566,590, filed Apr. 29, 2004 entitled "Columnar Block Fence System," both of which applications are hereby incorporated herein by reference.

Although particular embodiments have been disclosed herein in detail, this has been done for purposes of illustration only, and is not intended to be limiting with respect to the scope of the claims. In particular, it is contemplated that various substitutions, alterations and modifications may be made to the invention without departing from the spirit and scope of the invention as defined by the claims. For instance, the choice of materials or variations in the shape or angles at which some of the surfaces intersect are believed to be a matter of routine for a person of ordinary skill in the art with knowledge of the embodiments disclosed herein.

What is claimed is:

1. A fence, comprising:

at least two columns of blocks stacked in vertically aligned courses, wherein each block has an upper surface spaced apart from an opposed lower surface, thereby defining a block thickness, one of the upper surface and the lower surface having at least one projection extending therefrom, opposed first and second side surfaces extending between the upper and lower surfaces, opposed third and fourth side surfaces extending between the upper and lower surfaces, the upper and lower surfaces together with the side surfaces defining a block body, and a core, generally in a center of the block, wherein first and second adjacent blocks in a column are interlocked by receipt of a projection of the first block in the core of the second block, and at least one fence panel having first and second ends, the first end being connected to a first one of the two columns and the second end being connected to a second one of the two columns;

wherein at least one block of each column further has a recessed area in the upper surface of the one block extending from the core to a side surface of the one block; and wherein the at least one block is attached to the fence panel by means of a bracket, the bracket having a base portion constructed and dimensioned to fit over the recessed area, a first arm constructed and dimensioned to lie inside the one block core, and a second arm constructed and dimensioned to lie outside the one block side surface, the second arm constructed and dimensioned for fastening to the fence panel.

2. The fence of claim 1, wherein the cores of the blocks in the columns are vertically aligned and wherein the vertically aligned cores of the columns are filled with reinforcement.

3. The fence of claim 2, wherein the reinforcement is selected from steel pipe and post-tension rods.

4. The fence of claim 1, wherein the fence panel is selected from wood, vinyl, steel, wrought iron, aluminum, plastic, fiberglass, precast concrete, glass and plexiglas.

* * * * *

UNITED STATES PATENT AND TRADEMARK OFFICE

CERTIFICATE OF CORRECTION

PATENT NO. : 7,641,178 B2
APPLICATION NO. : 11/117638
DATED : January 5, 2010
INVENTOR(S) : MacDonald et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1034 days.

Signed and Sealed this

Sixteenth Day of November, 2010

David J. Kappos

David J. Kappos
*Director of the United States Patent and Trademark Office*